United States Patent [19]

Henrich

[11] 4,407,116

[45] Oct. 4, 1983

[54] APPARATUS OR STRANDING WIRE

[76] Inventor: Werner Henrich, Am Wachtgipfel, D-6349 Hörbach, Fed. Rep. of Germany

[21] Appl. No.: 303,382

[22] Filed: Sep. 18, 1981

[30] Foreign Application Priority Data

Sep. 18, 1980 [DE] Fed. Rep. of Germany ..... 3035208

[51] Int. Cl.[3] ..... D07B 3/04; D07B 3/06

[52] U.S. Cl. ..... 57/13; 57/6; 57/15; 57/58.34; 57/127.5; 57/59

[58] Field of Search ..... 57/3, 6, 13, 58.34, 57/58.36, 58.72, 58.81, 59, 67, 76, 77, 127.5, 314, 15; 242/25 R, 175

[56] References Cited

U.S. PATENT DOCUMENTS

| | | | |
|---|---|---|---|
| 1,063,646 | 6/1913 | Bournonville | 242/175 X |
| 2,929,193 | 3/1960 | Cook | 57/67 |
| 3,827,225 | 8/1974 | Schoerner | 57/58.34 X |
| 4,002,011 | 1/1977 | Tanaka et al. | 57/6 X |
| 4,236,373 | 12/1980 | Bravin | 242/25 R X |

FOREIGN PATENT DOCUMENTS

| | | | |
|---|---|---|---|
| 499246 | 11/1954 | Italy | 57/127.5 |

*Primary Examiner*—Donald Watkins
*Attorney, Agent, or Firm*—Edmund M. Jaskiewicz

[57] ABSTRACT

An apparatus for stranding wire, cables, ropes or the like, has one or more rotatable supports and a plurality of receptacles are non-rotatably mounted on each of the supports. A bundle of wound wire which is to be stranded is contained in each one of the receptacles which are positioned so that the axis of each bundle of wire is substantially parallel to the axis of rotation of the support. The wires from each of the bundles in a receptacle are then guided to a stranding point.

16 Claims, 9 Drawing Figures

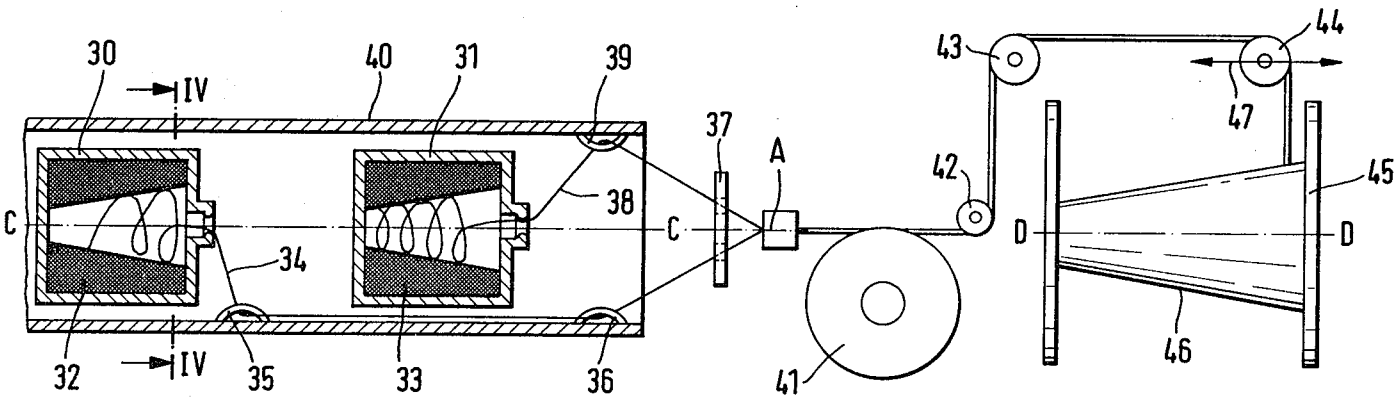
FIG. 3
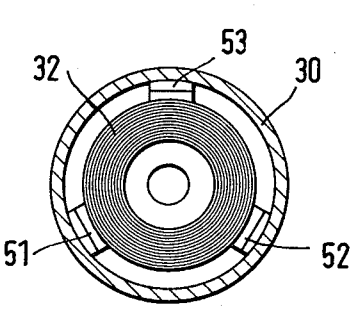
FIG. 4
FIG. 5
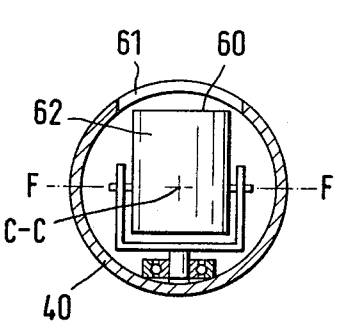
FIG. 6
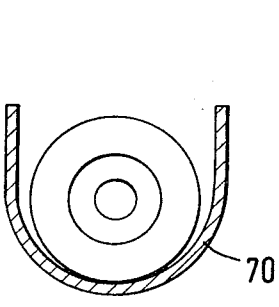
FIG. 7

FIG. 8
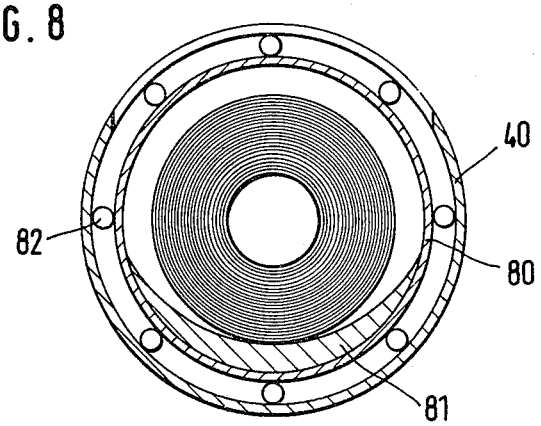
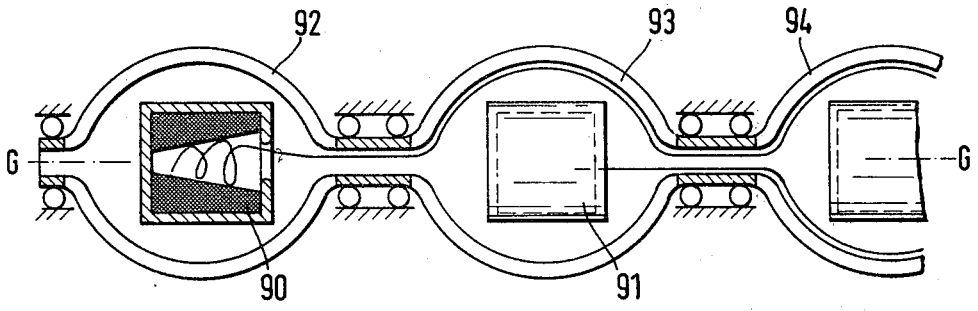
FIG. 9

APPARATUS OR STRANDING WIRE

The present invention relates to an apparatus for stranding filamentary materials such as wires, ropes, cables, and the like, more particularly, to the mounting in the stranding device of the bundles of wound wire from which wire is removed to be stranded.

In presently known wire stranding machines of the cage type the reels of wire which are to be stranded rotate in a circle around the stranding axis. These reels of wound wire are generally inserted in receptacles or frames on the rotatable supports which are in the form of cages. The axes of the receptacles for the reels are substantially parallel or at a slight angle to the axis of rotation of the cage support. The axes of the reels of wire in the receptacles are positioned perpendicularly with respect to the stranding axis or axis of rotation of the support and, in addition, are rotatable around their own axes, generally powered by a suitable geared mechanism.

The axes of the reels of wire may either be in horizontal positions (on twisting of the material to be stranded) or the positions of the axes of the reels are variable according to the angle of rotation (stranding machines without untwisting).

Based upon the number of wires which are to be stranded together and hence the corresponding same number of reels of wire, several caged supports can be spaced longitudinally or co-axially rotatably one behind the other. During the stranding process, the wires on a rear support cage were passed through openings in a front support cage on the way to the stranding point.

In a pipe or tubular stranding apparatus, the reels of wound wire which are to stranded are positioned generally co-axially one behind the other in a rotatable tubular element. In addition, the reels are mounted for rotation about their own axes and, also, are mounted so as to be pivotable within the tubular element. The single tubular element can be replaced by a number of co-axially disposed rotatable stranding frames one behind the other in order to reduce the mass of the rotating tubular element. On the inner wall of the tubular element or frames there are provided guide structures which guide the wire material to be stranded to the stranding point.

In all of these prior art stranding structures as described above, the wire or other filamentary material to be stranded is taken off tangentially to the reel. The traction force exerted on the material to be stranded during the stranding process thus effects rotation of the reel about its axis. In order to prevent any forward or over running of the reel and not to interfere with the unwinding of the wires during the stranding operation, the reel shafts or the reels themselves are braked, preferably with band or disk brakes.

The stranding machines as presently known have the disadvantage that the material to be stranded, as it is being taken off a reel, must move relatively large masses, namely, the mass of the reel and the mass of the material to be stranded which is wound upon the reel. In addition, the traction forces of the unwound material to be stranded must overcome the braking force of the above mentioned band or disk brakes. The movement of the large masses and the overcoming of the braking forces leads to unnecessary and undesirable stretching of the material to be stranded.

This stretching effect is further enhanced by the fact that during the stranding process the mass of the unwound material and the diameter of the material to be stranded on the unwinding reels varies. Thus, braking of the unwinding reels must vary because of the increasing speed of rotation of the reels as the mass of the unwound material thereon decreases. In addition, the weights of the reels must be carried along by the unwinding material and the bearing friction of the reel shafts must be overcome.

Thus, on the one hand, the quantity of the material to be stranded carried upon the reel is limited and, on the other hand, the takeoff speed of the material from the wheel and accordingly the stranding speed must be carefully controlled in order to ensure that none of the strands of material to be stranded breaks as the material is taken off of the respective reels.

It is, therefore, the principal object of the present invention to provide a novel and improved apparatus for stranding wire and the like.

It is another object of the present invention to provide an apparatus for stranding wire having an improved mounting of the reels of unwound material.

It is a further object of the present invention to provide an apparatus for stranding wire and the like which can accomodate large quantities of unwound wire without the risk of breaking of the wire during take-off from the reels and which enables the wire to be taken off of the reels at high speeds and the wire to be stranded at high speeds.

It is an additional object of the present invention to provide an apparatus for stranding wire which has high material take-off speeds and high stranding speeds but at the same time accomodates a much greater quantity of unwound material or wire.

According to one aspect of the present invention an apparatus for stranding wire and the like may comprise at least one support which is rotatable about an axis of rotation. Means are non-rotatably mounted on each said support for retaining a plurality of bundles of wound wire or other materials to be stranded. The bundles of wound wire each have an axis thereof which is substantially parallel to the axis of rotation of the support. Means are also provided for guiding the wire taken off from a bundle of wound wire in a retaining means to the stranding point.

It is apparent that the present invention achieves these objects by avoiding the rotatable mounting of reels but provides that the material to be stranded is merely taken off or unwound from bundles of wound wire so as to produce only extremely low traction forces on the material to be stranded. As a result, larger supplies of material to be stranded can be accommodated by the stranding apparatus without limiting in any way the stranding speed. The larger quantities of feed stock material to be stranded can be readily achieved by significantly increasing the axial lengths of the bundles of wound wire or material which is to be stranded. In spite of the greater weights of the feed strock of material to be stranded, the external dimensions of the rotating structures of the stranding apparatus and other components are not increased as would be the case with the use of conventional reels of wire. Thus, in spite of the higher operating speeds, no greater peripheral speeds of these components will exist. In addition, the heavy weights of the mounted receptacles of spindle sleeves and the weights of the reels themselves are eliminated.

Other objects and advantages of the present invention will be apparent upon reference to the accompanying description when taken in conjunction with the following drawings, which are exemplary wherein;

FIG. 3 is a view similar to that of FIG. 1 but of a stranding apparatus of the tube type incorporating the present invention;

FIG. 4 is a sectional view taken along the line IV—IV of FIG. 3;

FIG. 5 is a view similar to that of FIG. 4 but showing a structure for positioning a bundle within the tubular element;

FIG. 6 is a view similar to that of FIG. 4 but showing a further modification thereof;

FIG. 7 is a view similar to that of FIG. 4 but showing a further modification thereof;

FIG. 8 is a view similar to that of FIG. 4 but showing a still further modification of the stranding apparatus structure;

FIG. 9 is a view similar to that of FIG. 1 and showing schematically a further modification of the stranding apparatus.

Proceeding next to the drawings wherein like reference symbols indicate the same parts throughout the various views a specific embodiment and modifications of the present invention will be described in detail.

Figure 1:
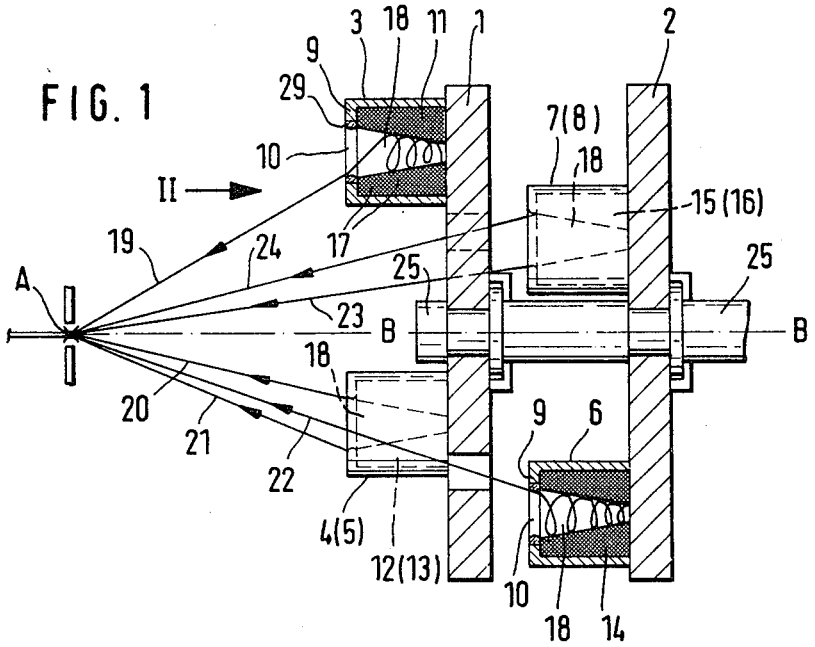
FIG. 1 is a side elevational view, partially in section, of a portion of a stranding apparatus according to the present invention.
Figure 2:
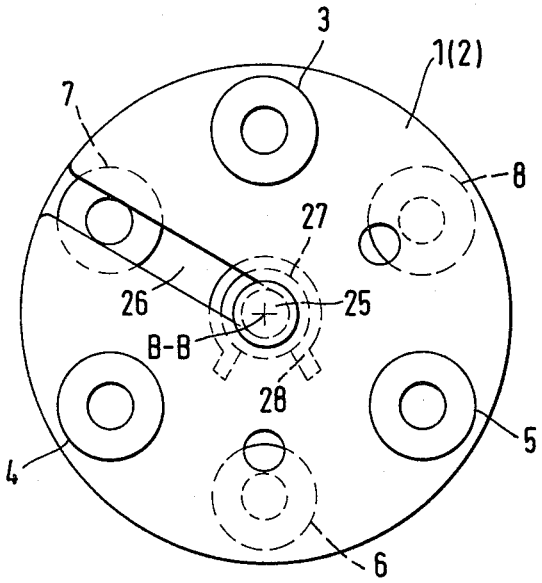
FIG. 2 is an end elevational view of the apparatus of FIG. 1 viewed in the direction of the arrow II.

In the stranding apparatus according to FIGS. 1 and 2 there are provided two disk shaped supports 1 and 2 which are mounted on a shaft 25 which is rotatable about the axis of rotation B—B. Fixed upon support disk 1 are three receptacles or containers 3, 4, and 5 and similarly fixed on support disk 2 are receptacles 6, 7, and 8. These receptacles are fixed upon the respective supports so as to be non-rotatable with respect to these supports. The containers are generally cylindrical in shape and are positioned so that their longitudinal axes are substantially parallel to the axis of rotation B—B. The open end of each of the receptacles is closed by a cover 9 which is particularly illustrated on the receptacles 3 and 6. In the middle of each cover 9 there is a substantially circular opening 10 within which is affixed a wear-resistant polished ring 29, which is preferably made of a ceramic material and over which the wire runs during unwinding or takeoff. The covers 9 are fastened to the open faces of the receptacles by means of snap closures or fasteners as known in the art.

After removal of the cover 9, a bundle of wound wire which is to be stranded 11–16 can be inserted into each of the receptacles 3–8 respectively. The wire bundles 11 and 14 which are in receptacles 3 and 6 respectively are shown in detail and each bundle comprises a plurality of conically arranged wire layers 17 so positioned that the inner wire layers in each bundle form a conical opening or bore 18 which is axially extending with respect to the respective bundle. The wire is then taken off or unwound from each bundle from the openings 18 and these wires 19–24 pass over the respective wear-resistance rings 29 and the covers 9 of the receptacles.

When the wires in the bundle are arranged in conical layers as at 17, the wires can then be withdrawn from the interior of the bundle without any problem of the bundle changing position within the receptacle since the bundle retains its original outline and shape and remains in position within its respective receptacle during the entire process during which the wire is unwound from the bundle.

The withdrawn wires 19–24 can then be supplied directly to a stranding point A or passed over suitable deflector or guide structures known in the art to the stranding point. If the disk supports 1 and 2 rotate, then the wires 19–24 are stranded at point A. A winding device as known in the art would then be provided subsequent to the stranding point A so as to wind up the stranded wire upon a reel.

When the inserted or assembled bundles of wire 11–16 have been completely unwound, the individual receptacles 3–8 may be then reloaded with new bundles of wire or the corresponding supports 1 or 2 can be removed from the shaft 25 and the receptacles loaded with wire bundles outside of the machine. It is preferable that the stranding apparatus comprise two supports 1 and 2 as illustrated but it should be borne in mind that the apparatus can also function with only one support or with more than two supports. Each support 1 and 2 is provided with a radially extending slot 26 which fits over the shaft 25 and through which the shaft is passed during removal or assembly of the disk from or upon the shaft. In order to secure supports 1 and 2 upon the shaft 25 each support is provided with a quick acting closure or clamping device 27 and 28. In order to remove a support 1 or 2, the respective clamp 27 or 28 is unlocked or opened so that the support can either be removed or will drop by itself off the shaft 25. When more than two supports are utilized and positioned longitudinally with respect to each other, the same construction may be used to remove and mount the supports upon the shaft.

When the support 1 or 2 is removed from the stranding machine, the support is then loaded outside of the machine by placing full bundles of wire within the receptacles and then closing the receptacles. The support with all of the receptacles occupied by full bundles of wire is then positioned as a unit upon the stranding machine. A suitable yoke or holding frame may be provided adjacent to the stranding machine for receiving and supporting a support when the receptacles on the support and being loaded with bundles of wire.

With a stranding machine equipped with two supports, it is apparent that one support can be loaded with full bundles of wire while the other is still in operation on the stranding machine. The result is a very short stopping or down time for the stranding apparatus in order to load bundles of wire on the apparatus.

FIG. 3 illustrates the invention as applied to a wire stranding apparatus of the pipe or tubular type. Receptacles 30 and 31 for receiving bundles of wound wire 32 and 33 are co-axially arranged in a pipe or tubular element 40 which is rotatable about an axis C—C. From the bundle 32 within receptacle 30, wire 34 is taken off through the central opening in the cover and passed through guides 35 and 36 mounted on the inner wall of the tubular element 40 through an apertured plate 37 rotatable with the tubular element 40 from which the wire is then supplied to the stranding point A. The guides 35 and 36 may be of the roller or fixed surface type as known in the art and are positioned substantially parallel with the axis of rotation C—C.

In a similar manner, from the bundle 33 retained in receptacle 31, wire 38 is withdrawn through a guide 39 similarly mounted on the inner wall of the tubular element 45 and supplied to the apertured plate 37. The wire 38 also moves from the apertured plate 37 to the stranding point A.

The receptacles 30 and 31 are preferably of the same construction as the receptacles 3–8 described in FIG. 1.

The wire which is stranded at A from the individual wires 34 and 38 is then guided over a rotatable guide pulley 41 and over guide rollers 42, 43 and 44 on a winding device to be wound around a stationary reel 45 having a conical core 46. Such winding devices are known in the art and may comprise a rotating cage within which are mounted the pulleys 43 and 44. In a manner also known in the art the guide roller 44 is reciprocable in the directions of the double ended arrow 47 so as to wind uniform conical layers of stranded wire about the core 46.

As also known in the art, the windup device may comprise a winding machine wherein the guide rollers are stationary and the reel is rotating.

While the particular embodiment of a tubular stranding device shown in FIG. 3 illustrates only two bundles mounted within the tubular elements, the tubular element 40 may be constructed of sufficient length to accomodate a larger number of wire bundles. In addition, the bundles of wound wire may be formed of an elongated or greater length than usual in order that each bundle may contain a considerably greater quantity of wire to be stranded. It is apparent that the larger quantity of wire contained within the individual bundles the longer the stranding device can operate without the necessity for replacing the bundles of wire.

While not shown in the drawings, the tubular element 40 is provided with openings of a suitable size and shape in its side wall in order to permit the insertion of the bundles within the tubular element.

In order to accurately and precisely position the bundles of wire or reels of wire within the receptacles 30 and 31 there may be provided on the inner wall of the receptacle 30, as shown in FIG. 5, three prism or wedge shaped bodies 51, 52 and 53 equidistantly spaced around the inner circumference of the receptacle member and within which the bundle is positioned as shown. The three bodies 51, 52 and 53 thus, in effect, constitute a three-point receptacle which will impart a stability to the bundle as wire is being unwound from the interior of the bundle.

In a further modification as shown in FIG. 6, a receptacle 60 is mounted upon a frame or structure so as to be pivotable about a horizontal axis F—F. The axis F—F extends transversely or diametrically of the tubular element 40. By means of this pivotal axis, the receptacle 60 is positioned vertically when a bundle 62 or a reel is to be inserted into the receptacle 60 through an opening 61 in the wall of the tubular element 40. After the receptacle 60 has been loaded, the receptacle is then pivoted ninety degrees about the axis F—F so that the longitudinal axis of the wire bundle 62, or that of the reel positioned therein, coincides with the axis of rotation C—C of the tubular member 40. The receptacle is then locked in this horizontal position with the aid of a structure which is not shown but known in the art. The locking structure can also function to lock the receptacle in a vertical position during the loading of the receptacle with a bundle of wire or a reel of wire.

In FIG. 7 there is shown a receptacle which is constructed as a half-shell or half-cylindrical member 70 within which the wire bundle or a reel of wire is readily inserted from above. In order to retain the wire bundle within the half shell during rotation of the tubular element 40, suitable means such as a cylindrical cover or retaining brackets may be employed to close the half shell at its open top portion.

In a further modification as shown in FIG. 8, the receptacle 80 is provided with a weight 81 which is below the center of gravity of the receptacle and as a result the wire bundle or reel retained in the receptacle will always be in the same position because of the downward force of gravity acting upon the weight 81. With the use of such a weight, it would therefore not be necessary to close the upper open portion of the shell 70 shown in FIG. 7. The presence of the weight would, in effect, cause the receptacles to pivot about the longitudinal axes as the support upon which the receptacle is mounted rotates during the stranding process. The receptacle 80 may be journalled or otherwise rotatably supported by rollers such as 82 in order that the receptacle is pivotable within the tubular element 40.

In FIG. 9 there is shown a tubular stranding apparatus in which the tubular element is replaced by a plurality of co-axially positioned frames. This modification corresponds to the construction of the wire stranding apparatus as disclosed herein with the difference that the wires withdrawn from the bundles 90 and 91 are guided by means of frames 92, 93, and 94 around the wire stock mounted in front of each wire bundle. The individual frames are rotatable about the axis G—G and replace the rotatable tubular element 40 shown in the modifications of FIGS. 3–8. The wire stranding apparatus of FIG. 9 has the particular advantage that the stocks of wire to be wound can be readily inserted or mounted within the respective frames.

It is therefrore apparent that the wire stranding apparatus of the present invention has the particular advantage that during the stranding process fewer stops of the stranding operation need be made in order to exchange an empty reel for a full reel or to insert a new bundle of wire to be wound. As a result, the productive output of the stranding apparatus is considerably enhanced. In addition, mechanical structures for the unwinding or taking off of the wires from the respective bundles of reels during stranding are eliminated since complex structures for mounting of the reels or bundles of wire are not necessary. The stranding apparatus thus has the advantage of shorter setup times, less down time and easier handling for replenishment with stocks of wire to be wound whereby the degree of utilization of the apparatus is considerably increased. Also, the stranding process as a whole can occur with considerably less expenditure of energy.

It will be understood that this invention is susceptible to modifications to adapt it to different usages and conditions and, accordingly, it is desired to comprehend such modifications within this invention as may fall within the scope of the appended claims.

What is claimed is:

1. In an apparatus for stranding wire and the like, the combination of at least one support rotatable about an axis of rotation, means non-rotatably mounted on each said support for retaining loosely therein a plurality of bundles of wound wire to be stranded, said bundles of wound wire each having an axis thereof substantially parallel to said axis of rotation, each wire bundle being retained against rotation around its axis, and means for guiding the wire directly taken off from the interior of a bundle in a said retaining means to a stranding point such that each bundle maintains its original outline and remains in position within its respective receptacle as wire is taken off from the bundle.

2. In an apparatus as claimed in claim 1 wherein each of said bundles comprises conical layers of wire to define an inner axially extending conical opening from which wire is unwound from a said bundle.

3. In an apparatus as claimed in claim 1 wherein said retaining means each has a wear resistant ring fastened thereto through which wire is taken off from the bundle therein.

4. In an apparatus as claimed in claim 3 wherein said ring comprises a circular polished member to guide wire therethrough.

5. In an apparatus as claimed in claim 4 wherein said ring is made of a ceramic material.

6. In an apparatus as claimed in claim 1 wherein said retaining means comprises a wear resistant receptacle.

7. In an apparatus as claimed in claim 1 wherein said retaining means each comprises a half shell.

8. In an apparatus as claimed in claim 1 wherein said retaining means each has three mounting points therein to position a wire bundle.

9. In an apparatus as claimed in claim 1 wherein said retaining means are each pivotable around a substantially horizontally extending axis and the center of gravity of the retaining means is below said pivot axis.

10. In an apparatus as claimed in claim 1 wherein there are a plurality of said supports and said supports are mounted upon a rotatable shaft, each said support has a quick operating closure device to clamp upon said shaft.

11. In an apparatus as claimed in claim 10 wherein each support has a radial slot through which said shaft is movable during the removal and mounting of a said support from and upon said shaft.

12. In an apparatus as claimed in claim 1 wherein said bundles of wound wire have an elongated axial extension.

13. In an apparatus as claimed in claim 12 wherein said apparatus comprises a tubular stranding apparatus and said bundles of wound wire are disposed co-axially therein.

14. In an apparatus as claimed in claim 13 wherein the tubular stranding apparatus comprises a rotatable tubular element within which the bundles of wire are positioned and guides fixed to the inner wall of said tubular element and extending substantially parallel to the rotary axis of the tubular element, the wire being unwound from the bundles passes over said guides to a stranding point.

15. In an apparatus as claimed in claim 13 wherein said retaining means are each pivotable about a horizontal axis and lockable in a selected pivoted position, a bundle of wound wire being inserted into a said retaining means with the axis of the bundle being in a vertical position and the retaining means and bundle therein being then pivoted into a horizontal position from which the wire is unwound from the bundle.

16. In an apparatus as claimed in claim 1 and further comprising a wire winding device receiving the stranding wire after the stranding point and comprising a rotatable flyer to wind the stranded wire into a conical bundle.

* * * * *